US007739992B2

(12) United States Patent
Okabe

(10) Patent No.: US 7,739,992 B2
(45) Date of Patent: Jun. 22, 2010

(54) STARTING SYSTEM FOR SMALL-SIZED ENGINE

(75) Inventor: Hiroshi Okabe, Tokyo (JP)

(73) Assignee: Starting Industrial Co., Ltd., Tokyo (JP)

( * ) Notice: Subject to any disclaimer, the term of this patent is extended or adjusted under 35 U.S.C. 154(b) by 0 days.

(21) Appl. No.: 12/309,041

(22) PCT Filed: Jun. 18, 2007

(86) PCT No.: PCT/JP2007/062248

§ 371 (c)(1),
(2), (4) Date: Jan. 5, 2009

(87) PCT Pub. No.: WO2008/004434

PCT Pub. Date: Jan. 10, 2008

(65) Prior Publication Data

US 2009/0114181 A1 May 7, 2009

(30) Foreign Application Priority Data

Jul. 6, 2006 (JP) ..... 2006-186805

(51) Int. Cl.
*F02N 11/14* (2006.01)
*F02N 5/02* (2006.01)
*F02N 3/02* (2006.01)

(52) U.S. Cl. ..... 123/179.24; 123/185.3

(58) Field of Classification Search ..... 123/179.24, 123/179.25, 179.26, 185.2, 185.3; 74/6, 74/7 E, 7 C See application file for complete search history.

(56) References Cited

U.S. PATENT DOCUMENTS

| | | | | | |
|---|---|---|---|---|---|
| 4,848,288 | A * | 7/1989 | Murase et al. | ..... | 123/179.24 |
| 4,930,467 | A * | 6/1990 | Masuda et al. | ..... | 123/179.24 |
| 5,010,858 | A * | 4/1991 | Schierling et al. | ..... | 123/179.24 |
| 5,072,627 | A * | 12/1991 | Horiye et al. | ..... | 74/6 |
| 5,083,534 | A * | 1/1992 | Morishima et al. | ..... | 123/185.14 |
| 5,113,816 | A * | 5/1992 | Morishima et al. | ..... | 123/179.25 |
| 5,163,392 | A * | 11/1992 | Morishima et al. | ..... | 123/179.25 |
| 6,240,889 | B1 * | 6/2001 | Kuwabara et al. | ..... | 123/179.24 |

(Continued)

FOREIGN PATENT DOCUMENTS

JP 2521096 B2 5/1996

(Continued)

*Primary Examiner*—Stephen K Cronin
*Assistant Examiner*—Arnold Castro
(74) *Attorney, Agent, or Firm*—Breiner & Breiner, L.L.C.

(57) ABSTRACT

A starting system for a small-sized engine is described which achieves downsizing, light-weight, and cost reduction of the system, prevents entry of dust or foreign substances at the time of assembly, and achieves easy assembly of a motor. The starting system for a small-sized engine includes a recoil starting system and a motor starting system integrated in a starter case, in which the motor starting system has a configuration in which a pinion is mounted on an output shaft of a reducer motor by an one-way clutch of a needle bearing and the pinion is engaged with a starting gear 6 of an engine, and the starter case has a configuration in which an inner lid is secured to a crankcase of the engine together by a screw and the inner lid has a joint portion with respect to the crankcase and a mounting seat for the reducer motor on the outside thereof.

2 Claims, 5 Drawing Sheets

U.S. PATENT DOCUMENTS

| | | | | |
|---|---|---|---|---|
| 6,374,791 | B1 * | 4/2002 | Kuwabara et al. | 123/179.25 |
| 7,594,490 | B2 * | 9/2009 | Ono | 123/179.24 |
| 2006/0027201 | A1 * | 2/2006 | Ono | 123/179.25 |
| 2008/0127930 | A1 * | 6/2008 | Thompson | 123/185.3 |
| 2008/0229879 | A1 * | 9/2008 | Nagahara et al. | 74/7 E |
| 2008/0257077 | A1 * | 10/2008 | Ono et al. | 74/6 |
| 2009/0038436 | A1 * | 2/2009 | Saito et al. | 74/7 E |
| 2009/0133531 | A1 * | 5/2009 | Ono et al. | 74/7 C |

FOREIGN PATENT DOCUMENTS

| | | | |
|---|---|---|---|
| JP | 2006-322354 | A | 11/2006 |

* cited by examiner

STARTING SYSTEM FOR SMALL-SIZED ENGINE

TECHNICAL FIELD

The present invention relates to a starting system for a small-sized engine which can be operated by a recoil starter or a motor starter.

BACKGROUND ART

In the related art, in the starting system for a small-sized engine, a configuration is known such that a rotor gear is penetrated through a spindle of a recoil starter and is engaged with a reduction gear of an electric starter motor juxtaposed with the recoil starter, and the rotor gear rotates only in one direction by a reel of the recoil starter and a one-way clutch provided on the reduction gear to transmit the rotation to a crankshaft (for example, see Patent Document 1).

The above-described starting system is also comprised of a pinion having the one-way clutch mounted on an intermediate shaft to which the rotation is transmitted from the starter motor via the reduction gear, and the pinion is engaged with a start gear of the engine. A starter case is upsized and the weight is increased correspondingly, thereby increasing the cost. In addition, since the starter case has an opened structure having no inner lid, dust or foreign substances enters easily at the time of assembly, and hence there arises a problem of difficulty of motor assembly.

Patent Document 1: Japanese Patent No. 2521096

DISCLOSURE OF INVENTION

Problems to be Solved by the Invention

It is an object of the present invention to solve the problems described above, and to provide a starting system for a small-sized engine, which achieves downsizing, light-weight, and cost reduction of the system, prevents entry of dust or foreign substances at the time of assembly, and achieves easy assembly of the motor.

Means for Solving the Problems

In order to solve the above-described problems, a starting system for a small-sized engine according to the present invention is characterized by the following configurations.

The invention relates to a starting system for a small-sized engine including a recoil starting system and a motor starting system integrated in a starter case, in which the motor starting system has a configuration in which a pinion is mounted on an output shaft of a reducer motor by an one-way clutch of a needle bearing and the pinion is engaged with a starting gear of an engine, and the starter case has a configuration in which an inner lid is secured to a crankcase of the engine together by a screw and the inner lid has a joint portion with respect to the crankcase and a mounting seat for the reducer motor on the outside thereof.

The invention further relates to the starting system for a small-sized engine characterized in that the one-way clutch of the needle bearing includes a detent projection or recess on the outer periphery thereof, and a receiving hole of the one-way clutch provided on the pinion includes on an inner periphery thereof a recess or a projection which engages the projection or the recess.

The invention further relates to the starting system for a small-sized engine characterized in that the inner lid of the starter case includes a fitting hole for a relay cam to which the rotation is transmitted from the starting gear via a shock-absorbing recoil spring at a portion corresponding to the starting gear, and the outer side of the fitting hole serves as a lid of a spring chamber being provided on the starting gear and storing the shock-absorbing recoil spring.

Effect of the Invention

In the present invention, the pinion is provided on the output shaft of the reducer motor by the one-way clutch of the needle bearing, and the pinion is engaged with the starting gear of the engine. Therefore, since the reduction gear is eliminated from the interior of the starter case, downsizing, light-weight, and cost reduction of the system are achieved. In addition, since the inner lid is provided on the starter case for closing the opening thereof, the inner lid prevents entry of dust and foreign substances at the time of assembly, and the assembly of the motor is facilitated.

In the present invention, since the detent projection and recess are provided on the outer periphery of the one-way clutch and in the receiving hole of the pinion so as to correspond thereto, and the rotation is transmitted by the engagement of the projection and recess, mounting of the clutch to the pinion is quickly achieved without the necessity of press-fitting or shrink fitting and demounting of the one-way clutch from the pinion is achieved as desired.

In addition, according to the present invention, since the inner lid of the starter case includes the fitting hole for the relay cam and the portion which serves as the lid of the spring chamber provided on the starting gear, even in the structure in which the relay cam is formed into a cap-shape and is supported at the center of the bottom strip with a mounting screw, the relay cam is stabilized by the peripheral support by the fitting hole and, in addition, the portion outside the fitting hole which serves as the lid of the spring chamber prevents the shock-absorbing recoil spring from jumping out from the spring chamber even when the shock-absorbing recoil spring which is engaged at an inner end with the relay cam is pulled by the relay cam when puling the relay cam out from the fitting hole.

EXPLANATIONS OF LETTERS OR NUMERALS

Figure 1:
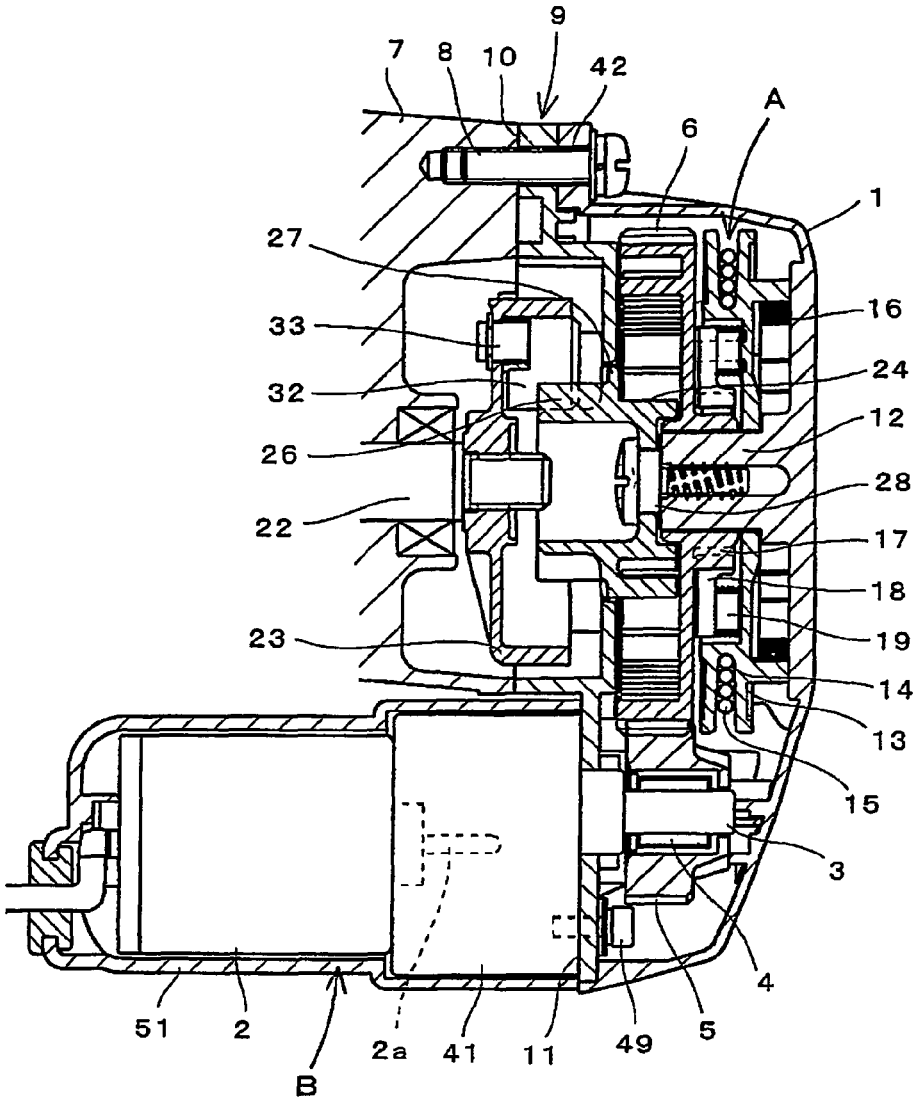
FIG. 1 is a cross-sectional view showing an embodiment of a starting system for a small-sized engine.

A a recoil starting system
B a motor starting system
1 starter case

2 reducer motor
3 output shaft
4 one-way clutch of a needle bearing
5 pinion
9 inner lid
10 joint portion with respect to crankcase
11 mounting seat of a motor

BEST MODES FOR CARRYING OUT THE INVENTION

Referring now to the drawings, an embodiment of a starting system for a small-sized engine according to the present invention will be described below.

A starting system for a small-sized engine shown in FIG. 1 includes a recoil starting system A and a motor starting system B stored in a starter case 1. The motor starting system B employs a configuration in which a pinion 5 is mounted to an output shaft 3 of a reducer motor 2 by an one-way clutch 4 of a needle bearing, and the pinion 5 is engaged with a starting gear 6 of an engine. The starter case 1 includes an inner lid 9 which is secured to a crankcase 7 of the engine together with a screw 8, and the inner lid 9 includes a joint portion 10 with respect to the crankcase 7 and a mounting seat 11 of the reducer motor 2 on the outside thereof.

Figure 6:
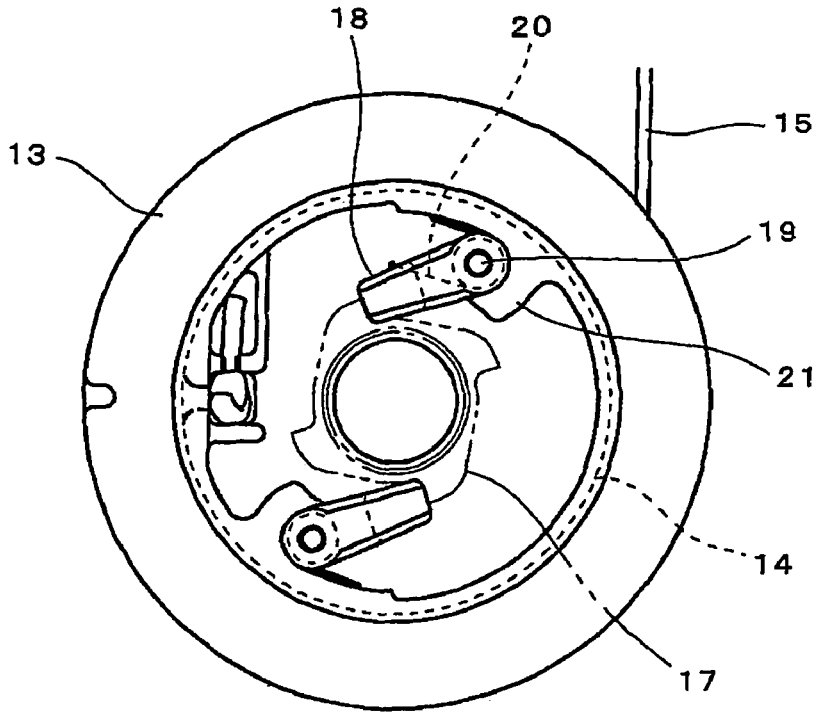
FIG. 6 is an explanatory drawing showing a link between a latchet supported by a reel and a cam of a starting gear.

The recoil starting system A described above is configured as shown in FIG. 1 in such a manner that a reel 13 is fitted to a spindle 12 provided at the center of the starter case 1, a groove 14 is provided on the periphery of the reel 13 for winding a rope 15, and a recoil spring 16 which is wound up by drawing out of the rope 15 and returns the rope by its restoring force when the rope 15 is released is provided between one side surface of the reel 13 and the starter case 1. In addition, on the other side surface of the reel 13, a plurality of latchets 18 which engage a cam 17 provided on the starting gear 6 are mounted to by a shaft 19 as shown in FIG. 6, and the latchets 18 are urged by a turn spring 20 against stopper strips 21 provided on one side of each.

Figure 4:
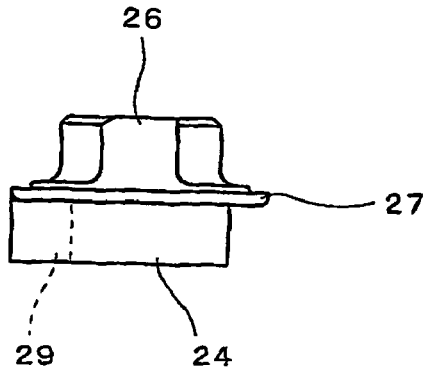
FIG. 4 is a side view of a relay cam.
Figure 5:
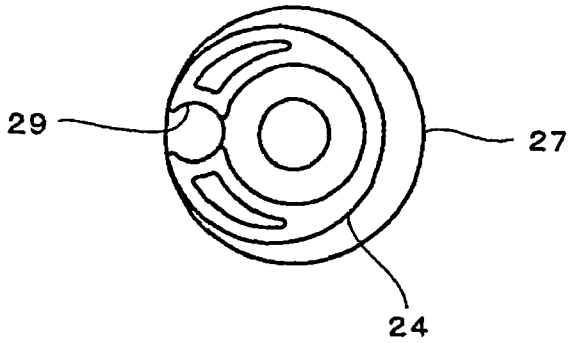
FIG. 5 is a lower side view of the same.
Figure 7:
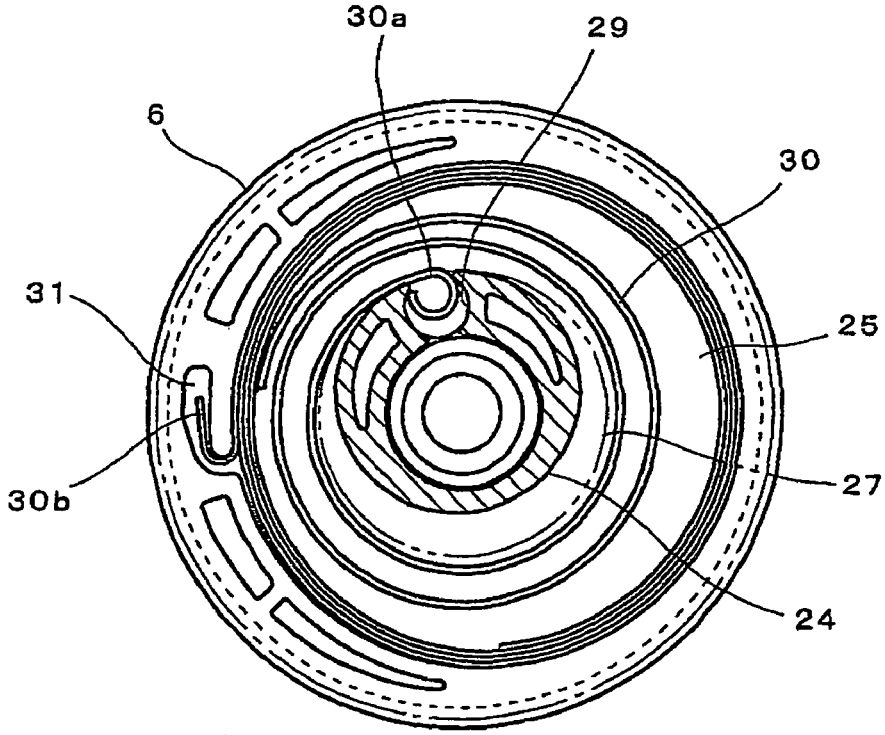
FIG. 7 is an explanatory drawing showing the starting gear and a passive portion of the relay cam linked by a shock-absorbing recoil spring.

In order to transmit the rotation from the starting gear 6 to a pulley 23 fixed to a crankshaft 22, a relay cam 26 whose passive portion 24 is positioned in a spring chamber 25 provided on the starting gear 6 as shown in FIG. 7 is used. The relay cam 26 is formed into a cap shape having a disk portion 27 which is positioned between the relay cam 26 and the passive portion 24 as shown in FIG. 4 and FIG. 5, and is mounted at the center of the bottom portion to an upper surface of the spindle 12 by a headed shaft 28 as shown in FIG. 1. Then, the passive portion 24 positioned in the spring chamber 25 is provided with a segmental groove 29 as shown in FIG. 7 to fit an inner end 30*a* of a shock-absorbing recoil spring 30 stored in the spring chamber 25, and an outer end 30*b* of the spring 30 is hooked on a hook groove 31 provided on the starting gear 6, so that the transmission of the rotation from the starting gear 6 to the relay cam 26 is achieved via the shock-absorbing recoil spring 30.

Figure 8:
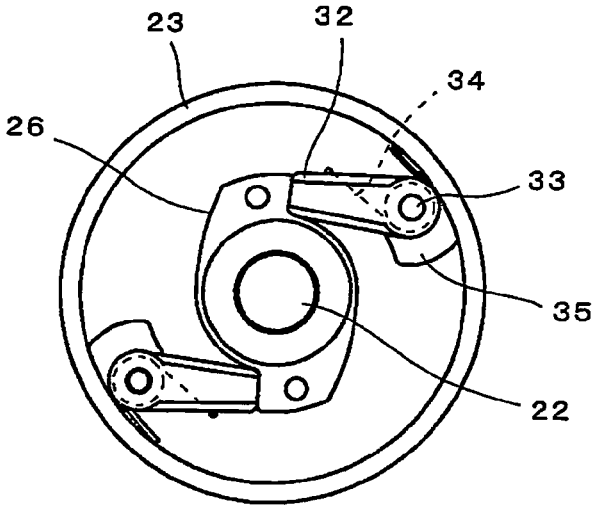
FIG. 8 is an explanatory drawing showing a link with a ratchet relay cam supported by a pulley.

A plurality of latchets 32 to be engaged with the relay cam 26 are mounted to the pulley 23 provided on the crankshaft 22 by a shaft 33, as shown in FIG. 8, and the latchets 32 are urged by a return spring 34 against stoppers 35 provided on one side.

Then, since the motor starting system B is configured in such a manner that the pinion 5 is mounted to the output shaft 3 of the reducer motor 2 by the one-way clutch 4 of the needle bearing and the pinion 5 is engaged with the starting gear 6 as described above, when motor-starting is carried out by rotating the reducer motor 2, the one-way clutch 4 of the needle bearing couples the output shaft 3 and the pinion 5 to transmit the rotation of the reducer motor 2 to the starting gear 6, and then from the starting gear 6 to the relay cam 26, the pulley 23, and the crankshaft 22 to start the engine. However, when starting by the recoil, since the one-way clutch 4 of the needle bearing releases the pinion 5 and the output shaft 3, the reducer motor 2 stays stopped even when the starting gear 6 rotates.

Figure 3:
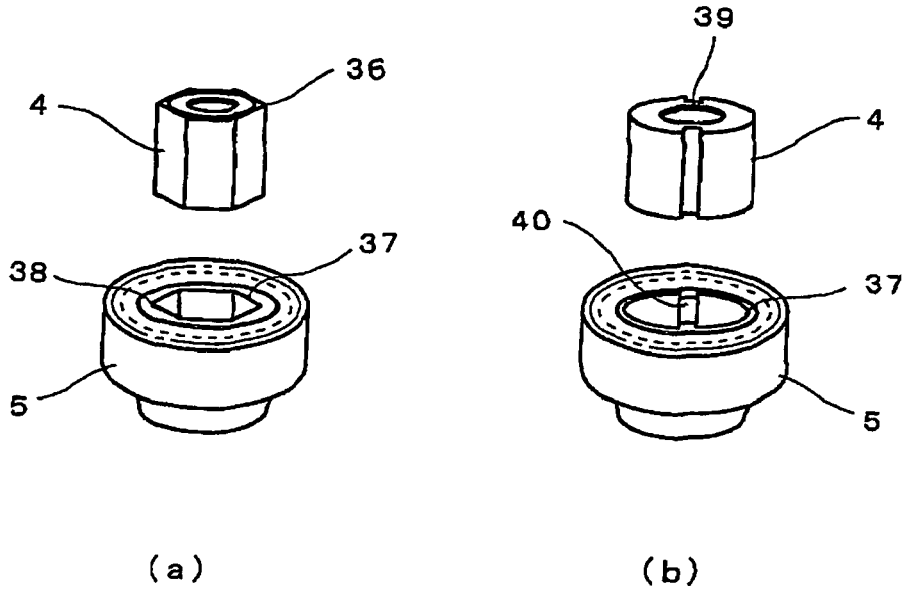
FIGS. 3(*a*) and (*b*) are explanatory drawings showing two examples of fitting between a pinion and a one-way clutch of a needle bearing.

The one-way clutch 4 of the needle bearing is preferably mounted easily and reliably to the pinion 5. Therefore, by configuring the one-way clutch 4 of the needle bearing in such a manner that a plurality of detent projections 36 are formed on the outer periphery thereof as shown in FIG. 3(*a*) so as to assume a polygonal shape such as hexagon, and a receiving hole 37 provided in the pinion 5 includes a plurality of detent recesses 38 on the inner periphery thereof so as to assume a polygonal shape such as hexagon as shown in the same drawing, or one or more detent recesses 39 are formed on the outer periphery of the one-way clutch 4 of the needle bearing as shown in FIG. 3(*b*), and the receiving hole 37 provided in the pinion 5 includes one or more detent projections 40 on the inner periphery thereof as shown in the same drawing, the transmission of the rotation from the one-way clutch 4 to the pinion 5 is ensured by the engagement between the projections and the recesses even though the fitting between the outer periphery of the one-way clutch 4 and the receiving hole 37 of the pinion 5 is loosened so as to allow easy fitting and pulling out.

Figure 2:
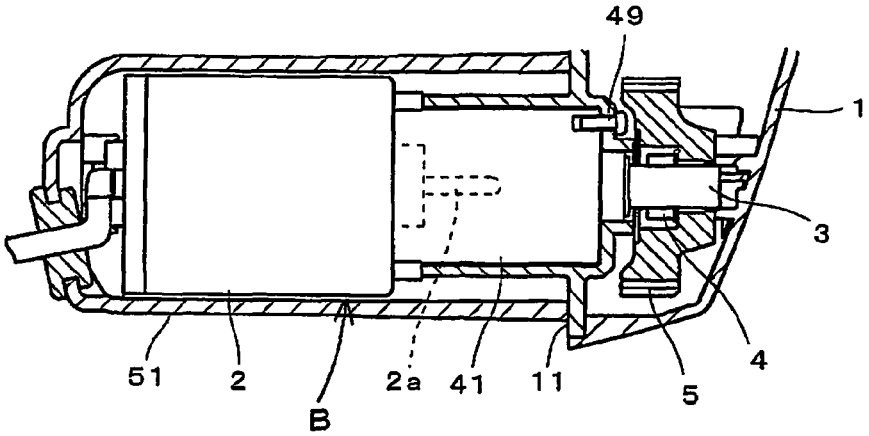
FIG. 2 is a cross-sectional view showing a part of another embodiment of the same system.

The reducer motor 2 is an integral combination of the motor 2 and a reducer 41 as shown in FIG. 1 and FIG. 2, and with the employment of such the reducer motor 2, the presence of a reduction gear in the starter case 1 is eliminated, so that downsizing, light-weight, and cost reduction of the system are achieved. As the reducer motor 2, as shown in FIG. 1, a spur gear reducer type whose output shaft 3 is deviated from a shaft 2*a* of the reducer motor 2 or a planetary gear reducer type whose output shaft 3 is aligned with the shaft 2*a* of the reducer motor 2 as shown in FIG. 2 is employed. However, in order to achieve the downsizing, light-weight, and cost reduction of the system, the planetary gear reducer type which is structurally compact and enables the weight reduction using resin gears is advantageous.

Figure 9:
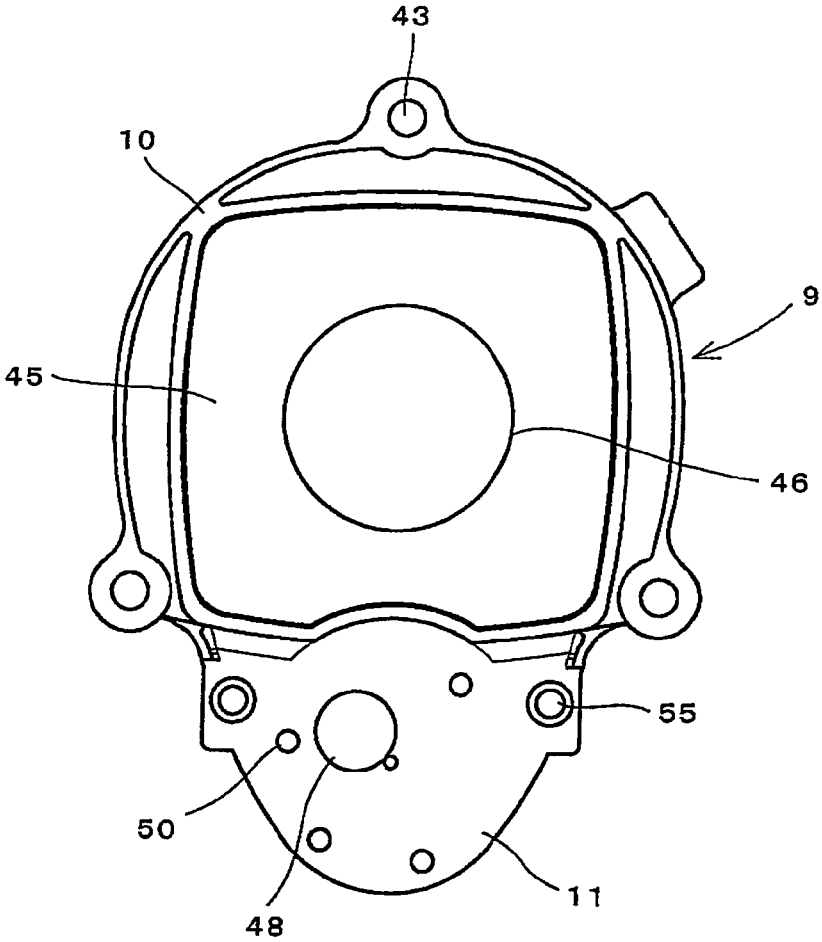
FIG. 9 is a front view showing an inner lid of a starter case. B4

The starting system is characterized in that the inner lid 9 is provided on the starter case 1. The inner lid 9 includes the joint portion 10 with respect to the crankcase 7 and the mounting seat 11 of the reducer motor 2 on one side as shown in FIG. 9 and FIG. 10, and the joint portion 10 includes a mounting hole 43 which is aligned with a mounting hole 42 provided on the periphery of the starter case 1, so that the crankcase 1 and the inner lid 9 can be mounted to the crankcase 7 together by passing a co-securing screw 8 into the mounting hole 42 and the mounting hole 43 and screwing the same into a screw hole 44 provided on the crankcase 7.

Figure 10:
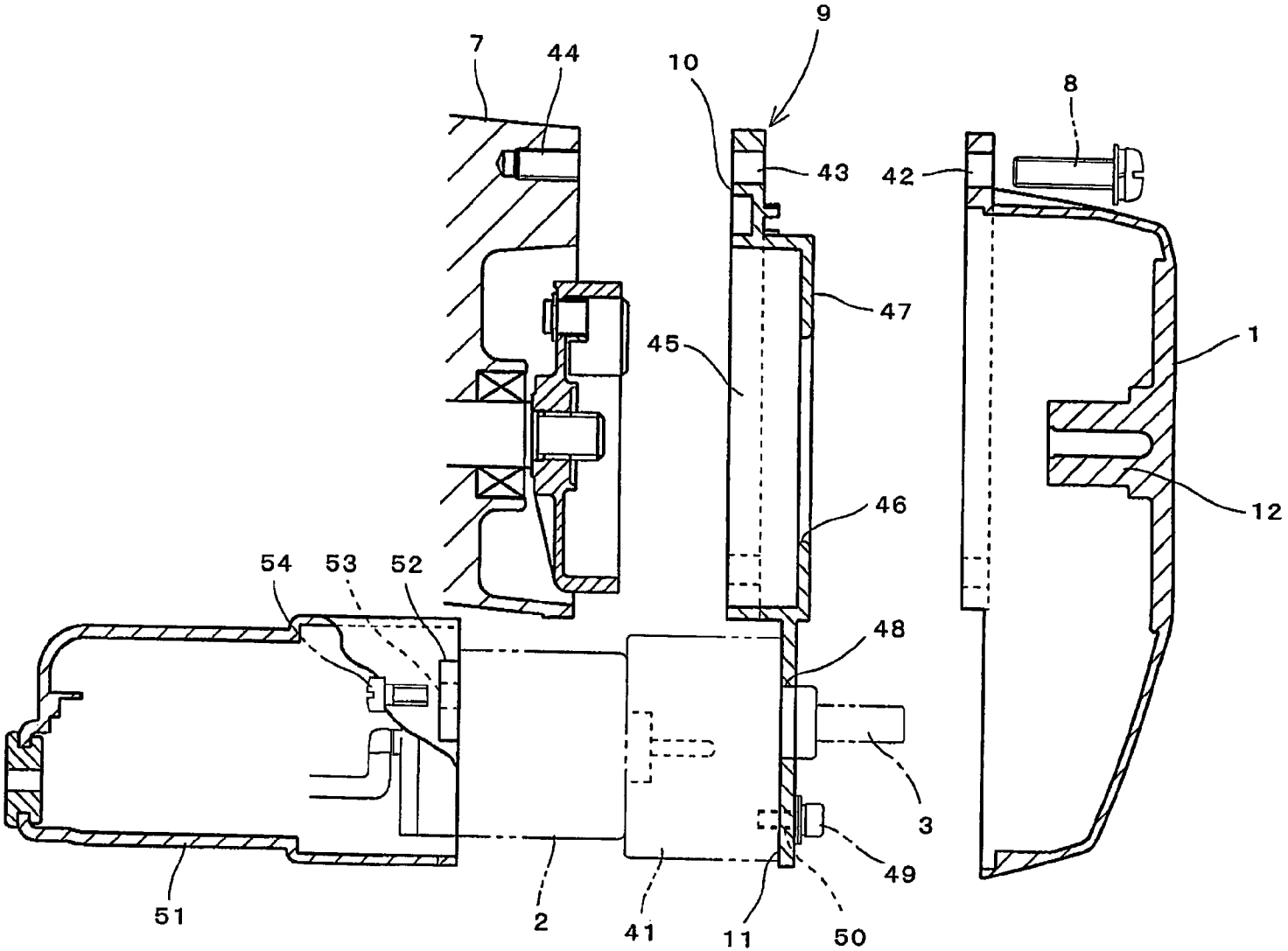
FIG. 10 is a explanatory drawing showing a combination of the starter case, the inner lid, a crankcase, and a motor cover.

The joint portion 10 of the inner lid 9 with respect to the crankcase 7 includes a recess 45 in which part of the pulley 23 is accommodated as shown in FIG. 10, and the recess 45 includes a fitting hole 46 formed at the center thereof. When the disk portion 27 of the relay cam 26 is fitted to the fitting hole 46, the relay cam 26 which is supported only at the bottom portion by the headed shaft 28 is also supported at the periphery thereof by the fitting hole 46, so that the relay cam 26 is stabilized.

A portion 47 of the recess 45 formed with the fitting hole 46 at the center as descried above located outside the fitting hole 46 corresponds to the spring chamber 25 provided in the starting gear 6 and functions as a lid which closes the spring chamber 25. Therefore, the shock-absorbing recoil spring 30 which engages at the inner end thereof with the segmental groove 29 provided on the passive portion 24 tries to accompany with the passive portion 24 when pulling the relay cam 26 out of the fitting hole 46, the portion 47 restricts it and prevents the shock-absorbing recoil spring 30 from jumping out from the spring chamber 25.

The mounting seat 11 of the motor is formed into a flat panel having the shape and the surface area which match the reducer 41 of the reducer motor 2, and includes a hole 48 which allows passage of the output shaft 3 of the motor 2 and a hole 50 which allows passage of a mounting screw 49. Therefore, when the output shaft 3 is passed through the hole 48, the reducer motor 2 is placed on the outer surface of the mounting seat 11, and the mounting screw 49 is screwed from the hole 50 to the reducer motor 2, the reducer motor 2 can be mounted to the mounting seat 11 easily.

The reducer motor 2 mounted to the mounting seat 11 as described above is protected by mounting a protection cover 51 as shown in FIG. 1 and FIG. 2. The protection cover 51 is formed into a shape which accommodates the reducer motor 2, and is adapted to mount the starter case 12 with the intermediary of the inner lid 9 by providing a mounting strip 52 on the periphery of the opening side as shown in FIG. 10, overlapping the mounting strip 52 on the mounting seat 11 of the motor, passing a screw 54 into a hole 53 and then into a hole 55 provided on the mounting seat 11 as shown in FIG. 9, and screwing the same into a screw hole, not shown, of the starter case 1.

An operation of the starting system will be described below.

When starting a small-sized engine by a motor, when an activating switch, which is not shown in the drawing since it is known, is turned on, the output shaft 3 of the reducer motor 2 rotates and, in this case, the one-way clutch 4 of the needle bearing couples the output shaft 3 and the pinion 5, transmits the rotation of the output shaft 3 to the starting gear 6 by the pinion 5, and rotates the starting gear 6. However, the shock-absorbing recoil spring 30 is present between the starting gear 6 and the passive portion 24 of the relay cam 26, and does not transmit the rotation to the passive portion 24 while it is wound up by the rotation of the starting gear 6, and transmits the rotation to the passive portion 24 when the winding limit is reached to rotates the relay cam 26 and the starting gear 6 together. Therefore, the relay cam 26 functions to cause the engine to start by transmitting the rotation to the pulley 23 by the latchets 32 and rotating the crankshaft 22 and, in this case, the reel 13 is stopped because the latchets 18 are arranged so as to avoid the cam 17 provided on the starting gear 6.

When starting the small-sized engine by the recoil, by pulling out the rope 15 wound around the groove 14 of the reel 13 abruptly, the latchets 18 engages the cam 17 provided on the starting gear 6 and rotates the starting gear 6. However, since the starting gear 6 and the passive portion 24 of the relay cam 26 links via the shock-absorbing recoil spring 30, as descried above, the starting gear 6 is adapted to start engine by being stopped when the shock-absorbing recoil spring 30 is being wound up, being rotated when it reaches the winding limit, transmitting the rotation from the relay cam 26 to the pulley 23, and rotating the crankshaft 22. In this case, the pinion 5 is rotated by the starting gear 6, but the one-way clutch 4 of the needle bearing mounted to the output shaft 3 of the reducer motor 2 releases the pinion 5 and the output shaft 3, so that the reducer motor 2 is not rotated.

INDUSTRIAL APPLICABILITY

The present invention can be used for achieving downsizing, light-weight, and cost reduction of the starting system for a small-sized engine.

The invention claimed is:

1. A starting system for a small-sized engine comprising a recoil starting system and a motor starting system integrated in a starter case, wherein the motor starting system has a configuration in which a pinion is mounted on an output shaft of a reducer motor by an one-way clutch of a needle bearing and the pinion is engaged with a starting gear of an engine, and the starter case has a configuration in which an inner lid is secured to a crankcase of the engine together by a screw and the inner lid has a joint portion with respect to the crankcase and a mounting seat for the reducer motor on the outside thereof, and wherein the one-way clutch of the needle bearing includes a detent projection or recess on an outer periphery thereof, and a receiving hole of the one-way clutch provided on the pinion includes on an inner periphery thereof a recess or a projection which engages the projection or the recess.

2. The starting system for a small-sized engine according to claim 1, wherein the inner lid of the starter case includes a fitting hole for a relay cam to which rotation is transmitted from the starting gear via a shock-absorbing recoil spring at a portion corresponding to the starting gear, and an outer side of the fitting hole serves as a lid of a spring chamber being provided on the starting gear and storing the shock-absorbing recoil spring.

* * * * *